US006062222A

United States Patent [19]

Lewis et al.

[11] Patent Number: 6,062,222

[45] Date of Patent: May 16, 2000

[54] FACE MASK FOR SELF CONTAINED BREATHING APPARATUS

[75] Inventors: R. David Lewis, Auburn; Craig Martin, Norcross, both of Ga.

[73] Assignee: International Safety Instruments, Inc., Lawrenceville, Ga.

[21] Appl. No.: 08/911,341

[22] Filed: Aug. 14, 1997

[51] Int. Cl.[7] ..... A62B 18/08

[52] U.S. Cl. ..... 128/207.11; 128/201.12; 128/206.27

[58] Field of Search ..... 128/201.12, 201.14–201.16, 128/205.25, 206.21, 206.23, 206.24, 206.27, 206.28, 207.11; 2/9, 12, 13, 424

[56] References Cited

U.S. PATENT DOCUMENTS

| | | | |
|---|---|---|---|
| 1,395,759 | 11/1921 | Monro . | |
| 2,388,713 | 11/1945 | Schutz et al. . | |
| 2,905,172 | 9/1959 | Rodenhouse . | |
| 2,951,418 | 9/1960 | Bitner et al. . | |
| 3,004,535 | 10/1961 | Nielson . | |
| 3,146,295 | 8/1964 | Roland . | |
| 3,563,236 | 2/1971 | Hansson | 128/206.24 |
| 3,563,640 | 2/1971 | Wise et al. . | |
| 3,602,219 | 8/1971 | Warncke . | |
| 4,029,092 | 6/1977 | Morgan . | |
| 4,057,057 | 11/1977 | Backlund . | |
| 4,069,516 | 1/1978 | Watkins, Jr. | 2/428 |
| 5,038,776 | 8/1991 | Harrison et al. | 128/207.11 |
| 5,069,205 | 12/1991 | Urso | 128/201.24 |
| 5,080,092 | 1/1992 | Jenna | 128/201.19 |
| 5,247,706 | 9/1993 | Mark | 2/9 |
| 5,394,568 | 3/1995 | Brostrom et al. | 2/452 |

*Primary Examiner*—Aaron J. Lewis
*Attorney, Agent, or Firm*—James B. Middleton; Walter A. Rodgers

[57] ABSTRACT

A face mask for a self contained breathing apparatus has two pairs of straps fixed to the frame of the mask, the straps being fixed to a net or woven head piece. The straps at the top of the head piece are fixed with respect to the mask, and the bottom straps are adjustable to tighten the mask against the face of the user. The nose cup has ribs that receive legs of a mounting member for eyeglasses. The eyeglasses include frames, with support arms that are slidably fixable to the mounting member. The mounting member moves towards and away from the eyes of the user, and the support arms move up and down with respect to the nose cup, for full adjustability of the eyeglasses. The nose cup of the face mask is adjustable by either removing a portion at the chin and shortening the mask, or simply removing the portion to allow the user's chin to extend beyond the nose cup while still inside the face seal. The seal for the mask has a single thickness in the forehead area for greater comfort while wearing a helmet, and is smaller at the temples for a tighter seal at the temples where users are frequently smaller.

15 Claims, 2 Drawing Sheets

FACE MASK FOR SELF CONTAINED BREATHING APPARATUS

BACKGROUND OF THE INVENTION

1. Field of the Invention

This invention relates generally to face masks, and is more particularly concerned with an improved face mask for a self contained breathing apparatus.

2. Discussion of the Prior Art

A face mask for a self contained breathing apparatus (SCBA) generally includes about six straps fixed to the face mask and to the head harness. The straps, typically, are elastic, and pass through roller buckles to allow easy tightening of the straps. The technique is to tighten each of the six straps to pull the mask's seal tightly against the face to effect a good seal. Since the straps are elastic, however, they tend to pull a person's hair during tightening. Further, the six straps and buckles are arranged so the person must pull on the straps in a direction towards his back to tighten the straps. This is an awkward task, and renders tightening of the mask slow and difficult. It is well known also that rubber tends to deteriorate from exposure to the ambient atmosphere, which may include chorine, ozone and other damaging chemicals. As a result, the straps may break at any time, without prior warning. If even one strap breaks, it will be understood that the seal between the mask and the person's face may be compromised since all six straps are tightened to effect the seal.

Another problem with the prior art face masks is the requirement for three different sizes of mask. Much of the reason for the different sizes is in the nose cup, since adults do not vary widely in the upper portion of the face; thus, the variation is from the bridge of the nose to the chin. Nevertheless, in order to fit everyone, manufacturers have made three different sizes of nose cups to fit the small, medium and large faces. Each of these sizes requires a different mold, which is quite expensive, though about 90% of the sales are of the medium size.

A great number of people have some refractive error in their normal eyesight, requiring correction with glasses. For people using face masks, the use of corrective lenses has been expensive and troublesome. One technique is to have the corrective lenses ground into the face mask itself. This is usually very expensive, and does not allow the sharing of masks. Another technique is to attach spectacles to nibs fixed to the mask, the nibs being adapted to receive the spectacle frames at the usual hinge point for the temple pieces. This arrangement causes difficulty in affixing the spectacles properly, and is time consuming. Another technique is to fix the spectacles to a bracket or the like that is fixed to the face plate. Again, there is some difficulty in obtaining proper alignment.

The seal around the face mask is a source of some problems. For a firefighter or the like who wears a helmet while wearing a face mask, the seal of the face mask tends to interfere with the helmet, rendering the helmet uncomfortable. Also, many people's heads are slightly smaller at the temples, which militates against a secure seal at the temples.

Thus, the prior art has not provided a face mask for a self contained breathing apparatus that is easily adaptable to a variety of different people with different physiognomies.

SUMMARY OF THE INVENTION

The present invention provides a face mask for a self contained breathing apparatus, the face mask including a head harness attached to the mask by a plurality of straps, all such straps being fixed to a headpiece of net or cloth form. Two of the straps are easily adjustable, and act on the headpiece to pull the seal of the face mask snugly against the face.

The nose cup in the face mask of the present invention is made in a medium size, and is altered to fit small and large people. For fitting small people, the lower area of the nose cup is cut out and fixed together to make the nose cup smaller; and, for fitting large people the lower portion of the nose cup is simply cut away to give some freedom. The face mask seal is maintained by the seal around the mask.

For people who need visual correction, the mask of the present invention defines a receptacle on the nose cup, the receptacle being designed to receive a mounting member. The mounting member then receives a sliding block that carries a pair of spectacles. Thus, any person can place his own mounting member, with spectacles attached, into the receptacle. The mounting member is movable with respect to the receptacle to allow adjustment towards and away from the person's face, and the sliding block allows movement up and down for proper alignment of the lenses with the eyes.

The seal of the mask of the present invention deviates slightly inwardly at the temples of the wearer so there will be a secure seal even with somewhat unusual physiognomy. Also, the seal at the forehead is reduced to a single thickness to reduce interference with helmets or the like.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
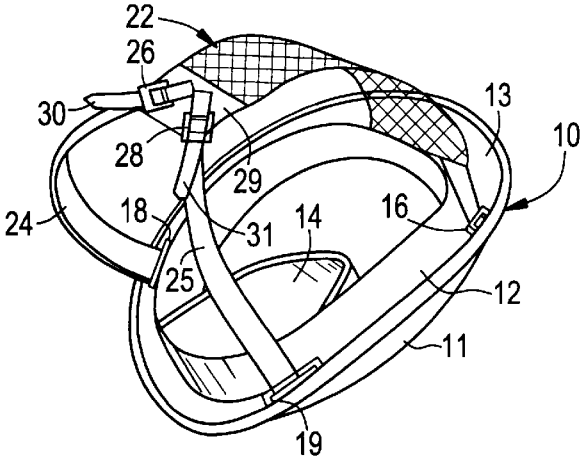
FIG. 1 is a perspective view showing a face mask made in accordance with the present invention.

Referring now more particularly to the drawings, and to those embodiments of the invention here presented by way of illustration, FIG. 1 shows a face mask 10 having a transparent face plate 11, an inner, full face seal 12 surrounding the face plate 11 and fixed to the frame 13, and a nose cup 14. Those skilled in the art will understand that the conventional face mask has about six points for attachment of straps to the frame 13, and a person must adjust each of the six straps to achieve uniform pressure, and good sealing between the person's face and the seal, such as the seal 12. In the mask of the present invention, however, there are only four points of attachment to the mask, and only two straps to adjust for a proper seal.

Figure 2:
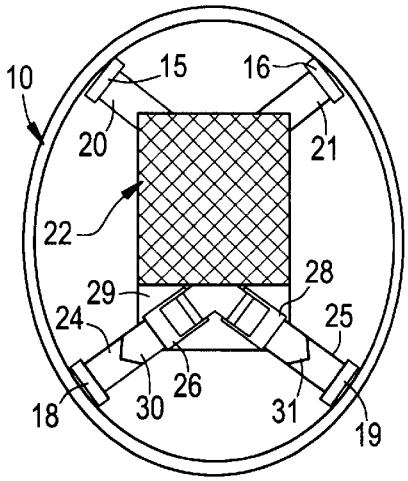
FIG. 2 is a schematic representation of the mask shown in FIG. 1, illustrating the rear elevational view.

Looking at FIG. 2 in conjunction with FIG. 1, it will be seen that there are four connecting points designated at 15, 16, 18 and 19. Straps 20 and 21 are connected to connecting points 15 and 16, and are also connected to a head piece 22. The straps 20 and 21 are preferably non-stretchable, and are permanently fixed to the head piece 22 and the frame 13 without buckles or the like for adjustment of the straps.

The head piece 22 is here illustrated as of a net form, but it should be understood that a woven fabric or the like can be used equally well. The head piece 22 should be made of a material that is not stretchable, but is preferably dimensionally unstable. For example, one preferred material is a net made of "Kevlar" (a polyaramid fiber) or other strong, non-elastic fiber. Numerous materials will suggest themselves to those skilled in the art.

Considering the mask as depicted in FIG. 1, it will be understood that the top of the mask 10 has the straps 20 and 21 fixed to the head piece 22. The bottom of the mask is held by straps 24 and 25 connected to connecting points 18 and 19 respectively. The straps 24 and 25 are engaged with buckles 26 and 28, the buckles 26 and 28 being fixed to an apron 29 on the head piece 22. It should therefore be understood that the buckles 26 and 28 are fixed with respect to the apron 29, and the straps 24 and 25 can be lengthened or shortened by appropriate manipulation of the buckles 26 and 28.

With the above and foregoing description in mind, the use of the device of FIGS. 1 and 2 should be understandable. One will first lengthen the straps 24 and 25 sufficiently to allow the straps 24 and 25 to pass on each side of the person's head, and to put the mask 10 in place on the face. When the mask 10 is properly positioned on the face, the head piece 22 will extend over the person's head, and somewhat down the back of the head. Next, the strap ends 30 and 31 are pulled. The buckles 26 and 28 will be conventional roller buckles so that pulling on the strap ends 30 and 31 will shorten the straps 24 and 25, and lifting the ends of the buckles will release the buckles and allow lengthening of the straps.

In the apparatus of the present invention, the head piece 22 extends generally over the head, so the strap ends 30 and 31 are positioned around the base of the skull, and are oriented so that the pulling force is in a generally forward and downward direction. Thus, the pulling is an easy, natural motion. When the two straps are shortened, the entire head piece 22 is tightened. The head piece is non-stretchable, but is dimensionally unstable, so the head piece conforms to the shape of the head, and the face mask 10 is pulled snugly against the face.

Those skilled in the art will understand that, for a mask such as the face mask 10 to fit properly, the nose cup 14 must fit properly. The nose cup 14 must fit over the bridge of the nose, and contain the mouth and chin. Because of this, face masks are generally made in three sizes, requiring three different molds for molding the three different nose cups. The present invention, however, provides a method for fitting all sizes with a single molded nose cup.

It should first be understood that the upper portions of adult faces are rather consistent, and it is the lower portion of the face that varies significantly. Furthermore, it has been found that a medium size nose cup will fit about 90% of the adult population, so the expense of making two additional molds is to fit only 10% of the population.

Figure 3:
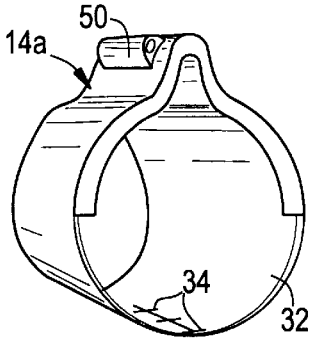
FIG. 3 is a perspective view of a nose cup for use in the mask of the present invention, and showing the nose cup modified for a small size.

The present invention comprises the making of only one size nose cup 14, and altering the nose cup to fit either a small or a large adult. FIG. 3 illustrates a nose cup 14*a* adjusted to fit a small person. The lower portion 32 that is designed to receive the person's chin has been cut and fixed together, as by staples 34. More specifically, a V-shaped piece will be removed from the portion 32, and the edges brought together and fastened. It will be understood that this shortens the nose cup from top to bottom. The cut edges can be fixed together by staples 34 as shown, or can be stitched, glued, or otherwise fastened.

Figure 4:
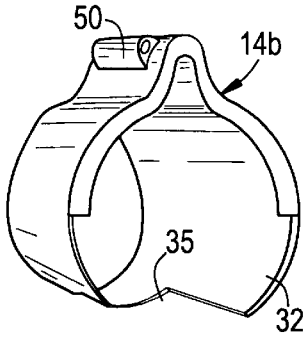
FIG. 4 is a view similar to FIG. 3, but showing the nose cup modified to be a large size.

FIG. 4 illustrates a nose cup 14*b* that has been altered to fit a large person. In this nose cup, it will be noticed that an area of the lower portion 32 has been cut away at 35. Since the lower part of the face is longer than average, simply removing enough of the nose cup 14*b* to allow room for the person's chin well adapts the mask. It will be understood that the nose cup 14*b* is within the seal 12, so the removed portion of the nose cup 14*b* causes no problem in use of the face mask 10.

Figure 5:
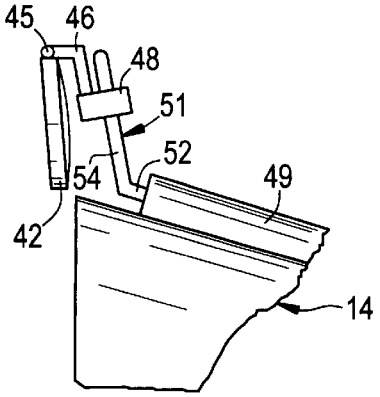
FIG. 5 is a fragmentary detail showing a side elevational view of the mounting for corrective lenses.
Figure 6:
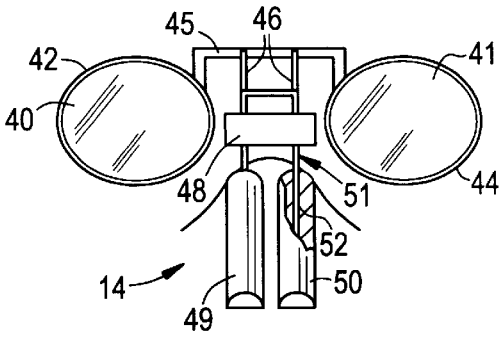
FIG. 6 is a front elevational view showing the arrangement pictured in FIG. 5.

Attention is next directed to FIGS. 5 and 6 of the drawings which show eyeglasses for use in a mask 10, and mounting means for the eyeglasses. It will be seen that the eyeglasses themselves comprise two lenses 40 and 41 mounted in frames 42 and 44, the frames 42 and 44 being connected together by a bridge 45.

A pair of support arms 46 is fixed to the bridge 45, and extend forward and down where they receive a block 48.

It will be easily recognized that eye glasses must be mounted close to the nose cup 14 because the bridge of the person's nose will be at the top of the nose cup, and the eyes must be adjacent. In the present invention, two ribs 49 and 50 are placed on the nose cup on each side of the apex of the nose cup. Each of the ribs 49 and 50 defines a hole longitudinally therein for receiving a mounting member 51. The mounting member 51 is here shown as formed of wire or the like and including a pair of legs 52, each leg being received by one of the ribs 49 and 50. The upper portion of the mounting member is bent upwardly as shown at 54, and passes through the block 48.

It will be therefore be understood that the mounting member 51 can slide into and out of the ribs 49 and 50 to move the upwardly bent portion 54 back and forth to be nearer to or farther from the eyes of the person wearing the mask 10. The holes in the ribs 49 and 50 are sized to grip the mounting member 51 sufficiently that the member will remain in the chosen position.

The block 48 is preferably formed of an elastomeric material, and the holes that receive the mounting member 51 are also small, so the block 48 will grip the mounting member 51. Thus, the block 48 can be raised or lowered on the mounting member 51 to place the lenses 40 and 41 properly with respect to the eyes of the person wearing the mask 10. Considering the structures of both the eyeglasses on the mounting member 51, and the mounting member 51 on the nose cup 14, it will be understood that the eyeglasses can be adjusted vertically so the eyes will be at the axes of the lenses, and horizontally to place the lenses the proper distance from the eyes.

Figure 7:
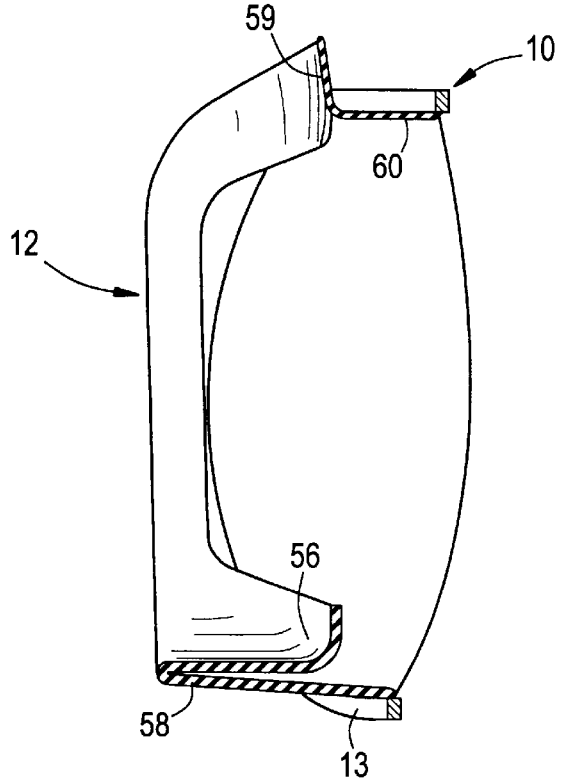
FIG. 7 is a vertical cross-sectional view of a face mask showing the seal; and, FIG. 8 is rear elevational view of the mask of FIG. 7.

Looking next at FIG. 7 of the drawings, the mask is again designated at 10 and the face seal at 12. FIG. 7 shows the mask in cross-section so the construction of the seal can be seen. It will be noticed that the material of the seal 12 extends from the face contacting portion to the rigid frame 13 of the mask 10. The usual construction is shown at the lower end of the mask 10 adjacent to the chin receiving area 56, and it will be noticed that there is a double thickness of rubber or other material at 58 to engage the face of the wearer. At the top of the seal 12, the portion 59 is adapted to engage the forehead of the wearer and seal thereagainst. In the conventional mask, this area too has a double thickness, being formed the same as the lower portion of the seal. In the mask of the present invention, however, the area 59 is a single thickness, and an integrally formed flange 60 extends to the rigid frame 55.

Thus, for firefighters and the like who wear a helmet while wearing a face mask, the portion 59 of the seal for the mask is thin enough to reduce the bulkiness of the seal, and the consequent discomfort of the helmet.

Figure 8:
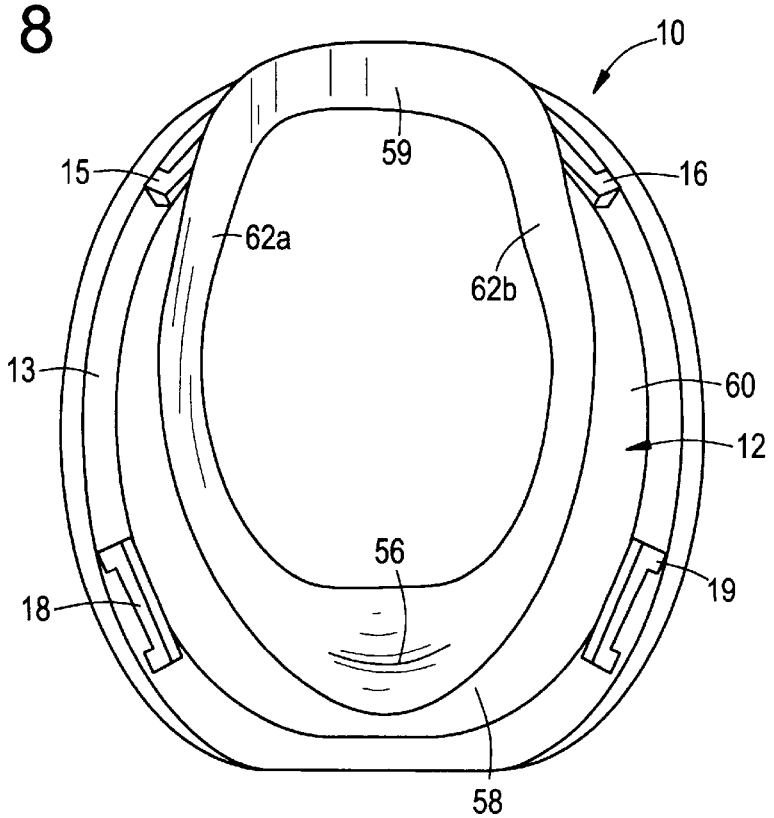

With attention now to FIG. 8 of the drawings, the rear elevation of the mask 10 is shown. The mask 10 is substantially the same as that depicted in FIGS. 1 and 2, so the same reference numerals are used. FIG. 8, however, shows the novel face seal 12 discussed in connection with FIG. 7.

Remembering that the seal 12 includes a flange 60 that extends from the face-contacting portion to the rigid frame 13, that flange 60 is shown somewhat in FIG. 8. In the area of the temples of the wearer, such areas being designated at 62*a* and 62*b*, the flange 60 is lengthened somewhat to position the temple portions 62 inwardly of the usual curve of the seal 12. Since the seal 12 is made of rubber or other elastomeric material there is sufficient resilience to fit a person who does not sink in at the temples; but, for those whose heads are smaller at the temples, the closer temple areas will assure a good seal.

It will therefore be seen that the present invention provides a face mask for a self-contained breathing apparatus that is easy and comfortable to use, and that can be adapted for use by any adult. The head harness is quick and simple to use, and is more comfortable than the conventional head harness. The nose cup allows one size of the nose cup to be adapted to any adult wearer; the seal adapts the mask to different physiognomies and uses; and, the eyeglasses mount provides for easy insertion and removal of eyeglasses. When the eyeglasses are installed, they can quickly be adjusted to fit the face of the wearer, and they will be held in place as long as required.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

What is claimed as invention is:

1. In the face mask for use with a self contained breathing apparatus, said face mask comprising a frame having a top and a bottom, a transparent face plate within said frame, a face seal fixed to said frame and surrounding said face plate, a nose cup within said face seal and towards said bottom of said frame, and strap means for holding said face mask to a user's face, the improvement wherein said strap means comprises a head piece having a top end portion adjacent to said top end of said frame and a bottom end portion adjacent to said bottom end of said frame, a first plurality of straps fixed to said top end portion of said head piece and to said top end of said frame, a second plurality of straps adjustably fixed to said bottom end portion of said head piece and fixed to said bottom end of said frame so that shortening said second plurality of straps pulls said head piece and causes said face seal to seal against a user's face, said second plurality of straps comprises a second pair of straps, said second pair of straps comprises a pair of buckles fixed to said bottom end portion of said head piece and a pair of longitudinal strap portions having first ends and second ends respectively, said first ends fixed to said bottom end of said frame, said second ends adjustably received by said buckles, said second ends being disposed adjacent a base of a user's skull and extending generally forward and downwardly with respect to a user's head, said second ends having free end portions, and said free end portions being rotated 180 degrees and being disposed intermediate said buckles and said frame.

2. In a face mask as claimed in claim 1, the further improvement wherein said head piece is non-stretchable and dimensionally unstable for conforming to a user's head.

3. In a face mask as claimed in claim 2, the improvement wherein said head piece is generally rectangular, said first plurality of straps comprises a first pair of straps fixed to the corners of said top end of said head piece for fixedly holding said head piece with respect to said frame.

4. In a face mask as claimed in claim 1, the improvement comprising a pair of eyeglasses within said face mask and supported adjacent to said nose piece, said eyeglasses comprising a pair of frames including a pair of lenses in said frames, a bridge fixed to said frames for holding said frames with respect to each other, a mounting member carried by said nose cup, and support arms fixed to said bridge and adjustably fixed to said mounting member.

5. In a face mask as claimed in claim 4, the further improvement comprising at least one rib on said nose cup, said rib defining a longitudinal hole therein, said mounting member including at least one arm slidably receivable within said longitudinal hole.

6. In a face mask as claimed in claim 5, the improvement comprising a block carried by said support arms, said block defining holes therethrough for slidably receiving said mounting member.

7. In a face mask as claimed in claim 1, wherein said face seal includes a forehead portion for contacting a wearer's forehead, the improvement wherein said face seal is of a single thickness at said forehead portion.

8. In a face mask as claimed in claim 1, wherein said face seal includes opposed temple portions, the improvement wherein said temple portions extend inwardly of the rest of said seal.

9. In a face mask for use with a self contained breathing apparatus, said face mask comprising a frame having a top and a bottom, a transparent face plate within said frame, a face seal fixed to said frame and surrounding said face plate, a nose cup within said face seal and towards said bottom of said frame, and strap means for holding said face mask to a user's face, the improvement comprising a pair of eyeglasses within said face mask and supported adjacent to said nose piece, said eyeglasses comprising a pair of frames including a pair of lenses in said frames, a bridge fixed to said frames for holding said frames with respect to each other, an upwardly angled mounting member carried by said nose cup, support arms fixed to said bridge, at least one rib on said nose cup, said rib defining a longitudinal hole therein, said mounting member including at least one leg slidably receivable within said longitudinal hole for Providing horizontal adjustment to said eyeglasses, a block carried by said support arms, and said mounting member slidably receivable in said block for providing vertical adjustment to said eyeglasses.

10. In a face mask as claimed in claim 9, the improvement wherein said strap means comprises a head piece having a top end adjacent to said top end of said frame and a bottom end adjacent to said bottom end of said frame, a first plurality of straps fixed to said top end of said head piece and to said top end of said frame, and a second plurality of straps adjustably fixed to said bottom end of said head piece and fixed to said bottom end of said frame, so that shortening said second plurality of straps pulls said head piece and causes said face seal to seal against a user's face.

11. In a face mask as claimed in claim 10, the further improvement wherein said head piece is non-stretchable and dimensionally unstable for conforming to a user's head.

12. In a face mask as claimed in claim 11, the improvement wherein said head piece is generally rectangular, said first plurality of straps comprises a first pair of straps fixed to the corners of said top end of said head piece for fixedly holding said head piece with respect to said frame.

13. In a face mask as claimed in claim 12, the further improvement wherein said second plurality of straps comprises a second pair of straps, said second pair of straps comprising a pair of buckles fixed to said bottom end of said head piece, and a pair of strap portions fixed to said bottom end of said frame and adjustably received by said buckles.

14. In a face mask for use with a self contained breathing apparatus, said face mask comprising a frame having a top and a bottom, a transparent face plate within said frame, a face seal fixed to said frame and surrounding said face plate, a nose cup within said face seal and towards said bottom of said frame, and strap means for holding said face mask to a user's face of the face mask, the improvement comprising said nose cup having a top end for engaging a bridge of a user's nose and a bottom end for receiving a user's chin, a portion of said bottom end being cutaway, said cutaway portion comprising a pair of edges, and said edges being detachably joined together along substantially the length of said edges.

15. In a face mask as claimed in claim 14, wherein said cutaway portion is V-shaped.

* * * * *